US009362639B2

(12) United States Patent
Zhang et al.

(10) Patent No.: US 9,362,639 B2
(45) Date of Patent: Jun. 7, 2016

(54) AUDIO JACK AND ELECTRONIC DEVICE INCLUDING SAME

(71) Applicant: Xiaomi Inc., Beijing (CN)

(72) Inventors: Lin Zhang, Beijing (CN); Yuan Gao, Beijing (CN); Gaocai Han, Beijing (CN)

(73) Assignee: Xiaomi Inc., Beijing (CN)

( * ) Notice: Subject to any disclaimer, the term of this patent is extended or adjusted under 35 U.S.C. 154(b) by 0 days.

(21) Appl. No.: 14/571,862

(22) Filed: Dec. 16, 2014

(65) Prior Publication Data

US 2015/0263443 A1 Sep. 17, 2015

(30) Foreign Application Priority Data

Mar. 17, 2014 (CN) ..... 2014 1 0097702

(51) Int. Cl.
*H01R 13/73* (2006.01)
*H01R 12/72* (2011.01)
*H01R 12/71* (2011.01)
(Continued)

(52) U.S. Cl.
CPC ..... *H01R 12/72* (2013.01); *H01R 12/714* (2013.01); *H01R 12/721* (2013.01); *H01R 12/722* (2013.01); *H01R 24/58* (2013.01); *H01R 12/7064* (2013.01)

(58) Field of Classification Search
CPC ..... H01R 2103/00; H01R 2105/00; H01R 2107/00; H01R 13/703; H01R 13/7032; H01R 13/7033; H01R 13/658; H01R 13/6658; H01R 24/46; H01R 23/025; H01R 23/7068; H01R 31/06; H01R 24/58; H04Q 1/142
USPC ..... 439/78, 79, 188, 668, 689, 76.1, 571
See application file for complete search history.

(56) References Cited

U.S. PATENT DOCUMENTS 4,647,136 A * 3/1987 Kinoshita ..... H01R 12/722 439/571
5,687,387 A * 11/1997 Endejan ..... G06F 1/1601 439/638
5,755,592 A * 5/1998 Hillbish ..... H01R 12/7064 439/541.5

(Continued)

FOREIGN PATENT DOCUMENTS

CN 2865069 (Y) 1/2007
CN 202004242 (U) 10/2011

(Continued)

OTHER PUBLICATIONS

International Search Report of PCT/CN2014/084453, from the State Intellectual Property Office of China, mailed Dec. 23, 2014.

(Continued)

*Primary Examiner* — Abdullah Riyami
*Assistant Examiner* — Vladimir Imas
(74) *Attorney, Agent, or Firm* — Finnegan, Henderson, Farabow, Garrett & Dunner LLP

(57) ABSTRACT

An audio jack includes an insulated base including an upper plate and a lower plate connected to the upper plate, wherein a connecting portion between the upper plate and the lower plate forms a socket for plugging an audio plug, and a slot, formed between facing surfaces of the upper plate and the lower plate, is configured for installing a circuit board in a plugging manner; and a metal contact terminal configured to electrically connect the audio plug plugged into the socket to a corresponding conductive trace on the circuit board installed in the slot.

14 Claims, 4 Drawing Sheets

(51) Int. Cl.
*H01R 24/58* (2011.01)
*H01R 12/70* (2011.01)

(56) References Cited

U.S. PATENT DOCUMENTS

| | | | | |
|---|---|---|---|---|
| 5,823,796 | A * | 10/1998 | Bethurum | G06K 19/077 361/737 |
| 5,951,317 | A * | 9/1999 | Tracy | H01R 13/6275 439/352 |
| 6,056,602 | A * | 5/2000 | Wu | H01R 13/641 439/668 |
| 6,093,058 | A * | 7/2000 | Wu | H01R 24/58 439/607.35 |
| 6,224,408 | B1 * | 5/2001 | Wu | H01R 13/7033 439/188 |
| 6,227,905 | B1 * | 5/2001 | Tsai | H01R 12/716 439/188 |
| 6,234,833 | B1 * | 5/2001 | Tsai | H01R 13/506 439/188 |
| 6,368,156 | B1 * | 4/2002 | Lin | H01R 24/76 439/188 |
| 6,435,917 | B1 * | 8/2002 | McDonald | H01R 24/58 439/206 |
| 6,524,118 | B1 * | 2/2003 | Kikuchi | H01R 24/50 439/629 |
| 6,626,706 | B2 * | 9/2003 | Siddiqui | H01R 24/58 439/668 |
| 6,629,851 | B1 * | 10/2003 | Kikuchi | H01R 24/50 439/629 |
| 6,736,651 | B2 * | 5/2004 | Ho | H01R 12/725 439/540.1 |
| 6,798,227 | B1 * | 9/2004 | Hwang | G01R 31/2806 324/750.22 |
| 6,964,586 | B2 * | 11/2005 | Siddiqui | H01R 24/58 439/218 |
| 6,976,870 | B1 * | 12/2005 | Li | H01R 13/514 439/541.5 |
| 7,217,159 | B2 * | 5/2007 | Chung | H05K 3/341 439/569 |
| 7,284,999 | B1 * | 10/2007 | Ju | H01R 13/24 439/188 |
| 7,326,067 | B2 * | 2/2008 | Karamooz | H01R 43/205 439/79 |
| 7,341,491 | B2 * | 3/2008 | Zhu | H01R 24/58 439/668 |
| 7,470,146 | B1 * | 12/2008 | Chen | H01R 12/716 439/541.5 |
| 7,534,146 | B2 * | 5/2009 | Chien | H01R 24/58 439/668 |
| 7,559,801 | B1 * | 7/2009 | Lin | H01R 13/65802 439/607.01 |
| 7,628,628 | B2 * | 12/2009 | Matsuda | H01R 13/6315 439/247 |
| 7,637,787 | B2 * | 12/2009 | Chien | H01R 24/58 439/668 |
| 7,866,991 | B2 | 1/2011 | Liu | |
| 7,922,543 | B1 * | 4/2011 | Chen | H01R 13/703 439/668 |
| 7,963,784 | B1 * | 6/2011 | Su | H01R 13/703 439/188 |
| 7,988,498 | B1 | 8/2011 | Lim et al. | |
| 8,221,160 | B2 * | 7/2012 | Liu | H01R 13/6658 439/540.1 |
| 8,251,753 | B2 * | 8/2012 | Guo | H01R 12/57 439/668 |
| 8,913,394 | B2 * | 12/2014 | Weber | G06F 1/186 361/728 |
| 8,944,828 | B2 * | 2/2015 | Tsao | H01R 12/79 439/67 |
| 8,998,622 | B2 * | 4/2015 | Gilbert | H05K 3/361 439/67 |
| 9,112,327 | B2 * | 8/2015 | Sarwar | H01R 24/60 |
| 2006/0148314 | A1 * | 7/2006 | Castaneda | H01R 9/091 439/581 |

FOREIGN PATENT DOCUMENTS

| | | | |
|---|---|---|---|
| CN | 202095071 (U) | | 12/2011 |
| CN | 202454782 (U) | | 9/2012 |
| CN | 202564660 | | 11/2012 |
| CN | 203071280 (U) | | 7/2013 |
| CN | 203456642 | | 2/2014 |
| CN | 103887643 | | 6/2014 |
| CN | 203774526 | | 8/2014 |
| EP | 1 122 822 | A2 | 5/2001 |
| JP | H0660927 | | 3/1994 |
| KR | 20100119393 | | 11/2010 |

OTHER PUBLICATIONS

European Search Report from European Patent Office for Application No. 15151324.9-1801 mailed Jul. 15, 2015, 6 pages.

* cited by examiner

AUDIO JACK AND ELECTRONIC DEVICE INCLUDING SAME

CROSS-REFERENCE TO RELATED APPLICATIONS

This application is based upon and claims priority to Chinese Patent Application No. 201410097702.6, filed Mar. 17, 2014, the entire contents of which are incorporated herein by reference.

TECHNICAL FIELD

The present disclosure generally relates to the field of electronic technology and, more particularly, to an audio jack and an electronic device including the audio jack.

BACKGROUND

An audio jack, such as an earphone jack, is a component commonly used in an electronic device for connecting an audio plug with a circuit board in the electronic device to form a signal path for audio signal transmission.

Conventionally, the audio jack is generally designed in a crimping-on-board type. That is, a plurality of terminals which can be crimped on the circuit board are provided interleavingly in a body of the audio jack. A terminal is generally a strip metal sheet. One end of the terminal is provided at an insulated frame of the body of the audio jack, and the other end of the terminal extends inwardly to be crimped on the circuit board so as to contact a contact point on the circuit board. In the process of crimping, the cooperation of an external configuration, such as a phone shell, is generally needed for the audio jack to crimp the other end of the terminal on the circuit board.

However, without the cooperation of the external configuration, the audio jack may not be crimped on the circuit board separately. In addition, the whole body of the audio jack is located on one side of the circuit board, and thus a relatively large space is occupied, which may not meet design requirements for an ultrathin electronic device.

SUMMARY

According to a first aspect of the present disclosure, there is provided an audio jack, comprising: an insulated base including an upper plate and a lower plate connected to the upper plate, wherein a connecting portion between the upper plate and the lower plate forms a socket for plugging an audio plug, and as slot, formed between facing surfaces of the upper plate and the lower plate, is configured for installing a circuit board in a plugging manner; and a metal contact terminal configured to electrically connect the audio plug plugged into the socket to a corresponding conductive trace on the circuit board installed in the slot.

According to a second aspect of the present disclosure, there is provided an electronic device, comprising: a circuit board; and an audio jack coupled to the circuit board, wherein the audio jack includes: an insulated base including an upper plate and a lower plate connected to the upper plate, wherein a connecting portion between the upper plate and the lower plate forms a socket for plugging an audio plug, and a slot, formed between facing surfaces of the upper plate and the lower plate, is configured for installing the circuit board in a plugging manner; and a metal contact terminal configured to electrically connect the audio plug plugged into the socket to a corresponding conductive trace on the circuit board installed in the slot.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate embodiments consistent with the invention and, together with the description, serve to explain the principles of the invention.

DETAILED DESCRIPTION

Reference will now be made in detail to exemplary embodiments, examples of which are illustrated the accompanying drawings. The following description refers to the accompanying drawings in which the same numbers in different drawings represent the same or similar elements unless otherwise represented. The implementations set forth in the following description of exemplary embodiments do not represent all implementations consistent with the invention. Instead, they are merely examples of apparatuses and methods consistent with aspects related to the invention as recited in the appended claims.

Figure 1:
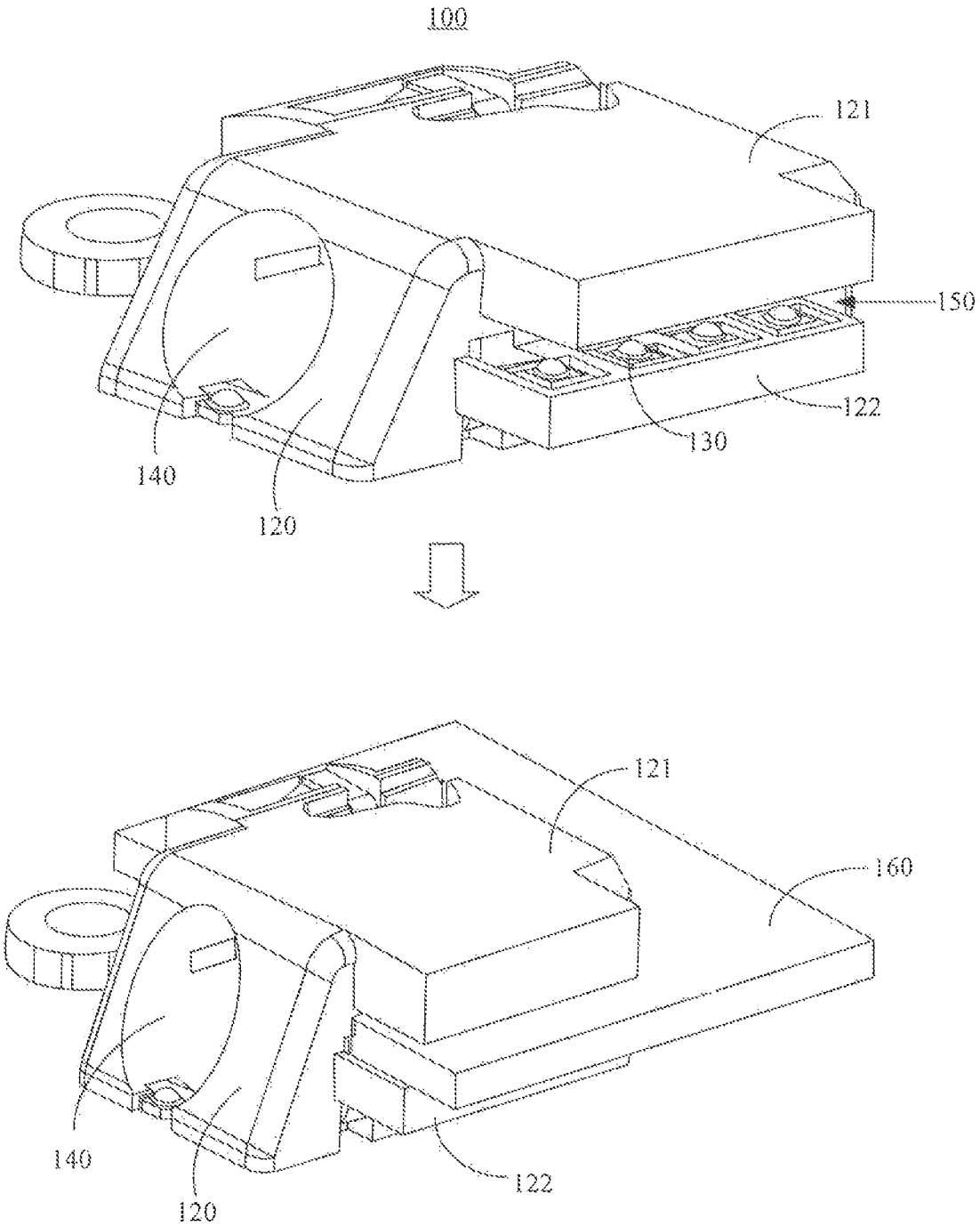
FIG. 1 is a schematic diagram of an audio jack, according to an exemplary embodiment.

FIG. 1 is a schematic diagram of an audio jack 100, according to an exemplary embodiment. Referring to FIG. 1, the earphone jack 100 includes an insulated base 120 and at least one metal contact terminal 130 located in the insulated base 120.

In exemplary embodiments, the insulated base 120 includes an upper plate 121, and a lower plate 122 connected with the upper plate 121. A connecting portion between the upper plate 121 and the lower plate 122 is configured to form a socket 140 for plugging an audio plug. In one exemplary embodiment, the insulated base 120 is a plastic base.

In exemplary embodiments, a slot 150 is formed between surfaces of the upper plate 121 and the lower plate 122 that face each other, referred hereafter as the facing surfaces of the upper plate 121 and the lower plate 122. The slot 150 is configured for installing the circuit board 160 in a plugging manner along the slot 150.

In exemplary embodiments, the at least one metal contact terminal 130 electrically connects the audio plug which is plugged into the socket 140 to a corresponding conductive trace on the circuit board 160 installed in the slot 150.

In one exemplary embodiment, the socket 140 has a cylinder shape. Different shapes may also be used as desired, which is not limited herein.

In one exemplary embodiment, first and second parallel slots 150 are formed between the facing, surfaces of the upper plate 121 and the lower plate 122. The facing surfaces of the upper plate 121 and the lower plate 122 are configured to hold the circuit board 160 after the circuit board 160 is plugged along the first and second parallel slots 150.

In one exemplary embodiment, the upper plate 121 and the lower plate 122 may each have a rectangular shape, a circle shape, or an irregular polygon shape. The shape of the upper plate 121 and the lower plate 122 may be specifically adjusted according to design requirements of an electronic device including the audio jack 100, which is not limited herein.

In one exemplary embodiment, a U-shaped slot may be formed between the facing surfaces of the upper plate 121 and the lower plate 122, i.e., the slot 150 formed as a third slot connecting the first and second parallel slots 150. For example, the third slot 150 is perpendicular to the first and second parallel slots 150. When the circuit board 160 is plugged into the U-shape slot, a part or the whole of the circuit board 160 is inlaid in the U-shape slot, and the U-shape slot holds the circuit board 160 to fix the circuit board 160 on the insulated base 120.

Figure 2A:
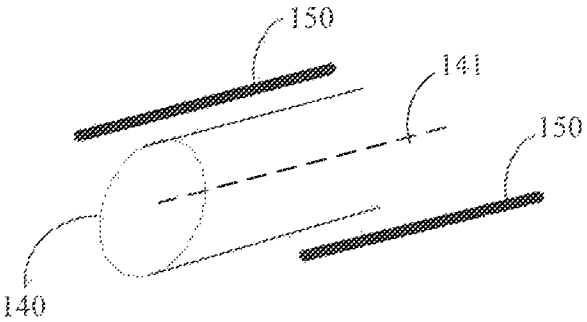
FIG. 2A is a schematic diagram showing a position relationship between a socket and a slot, according to an exemplary embodiment.

In exemplary embodiments, a central axis line 141 of the socket 140 is parallel to the first and second parallel slots 150, as shown in FIG. 2A.

In exemplary embodiments, the audio jack 100 includes a plurality of metal contact terminals 130, such as 5 or 6 metal contact terminals 130, and the metal contact terminals 130 are insulated from each other.

In exemplary embodiments, a first end of the metal contact terminal 130 forms a contact point in the socket 140, and a second end of the metal contact terminal 130 forms a contact point in the slot 150. When the audio plug is plugged into the socket 140, a metal head of the audio plug contacts the contact point in the socket 140 formed by the first end of the metal contact terminal 130, and is electrically connected with the corresponding conductive trace on the circuit board 160, which is installed in the slot 150, through the contact point in the slot 150 formed by the second end of the metal contact terminal 130, so as to provide a signal path for audio signal transmission.

In exemplary embodiments, the contact point in the slot 150 formed by the second end of the metal contact terminal 130 is an elastic contact point. The elastic, contact point may be a spring-type elastic contact point, or a clip-type elastic contact point.

In exemplary embodiments, contact points in the slot 150 formed by the metal contact terminals 130 are evenly arranged in a slot direction of the slot 150. The contact points in the slot 150 may be all arranged on the facing surface of the lower plate 122, or may be all arranged on the facing surface of the upper plate 121. Alternatively, a first part of the contact points may be arranged on the facing surface of the lower plate 122, and a second part of the contact points may be arranged on the upper plate 121.

Figure 2B:
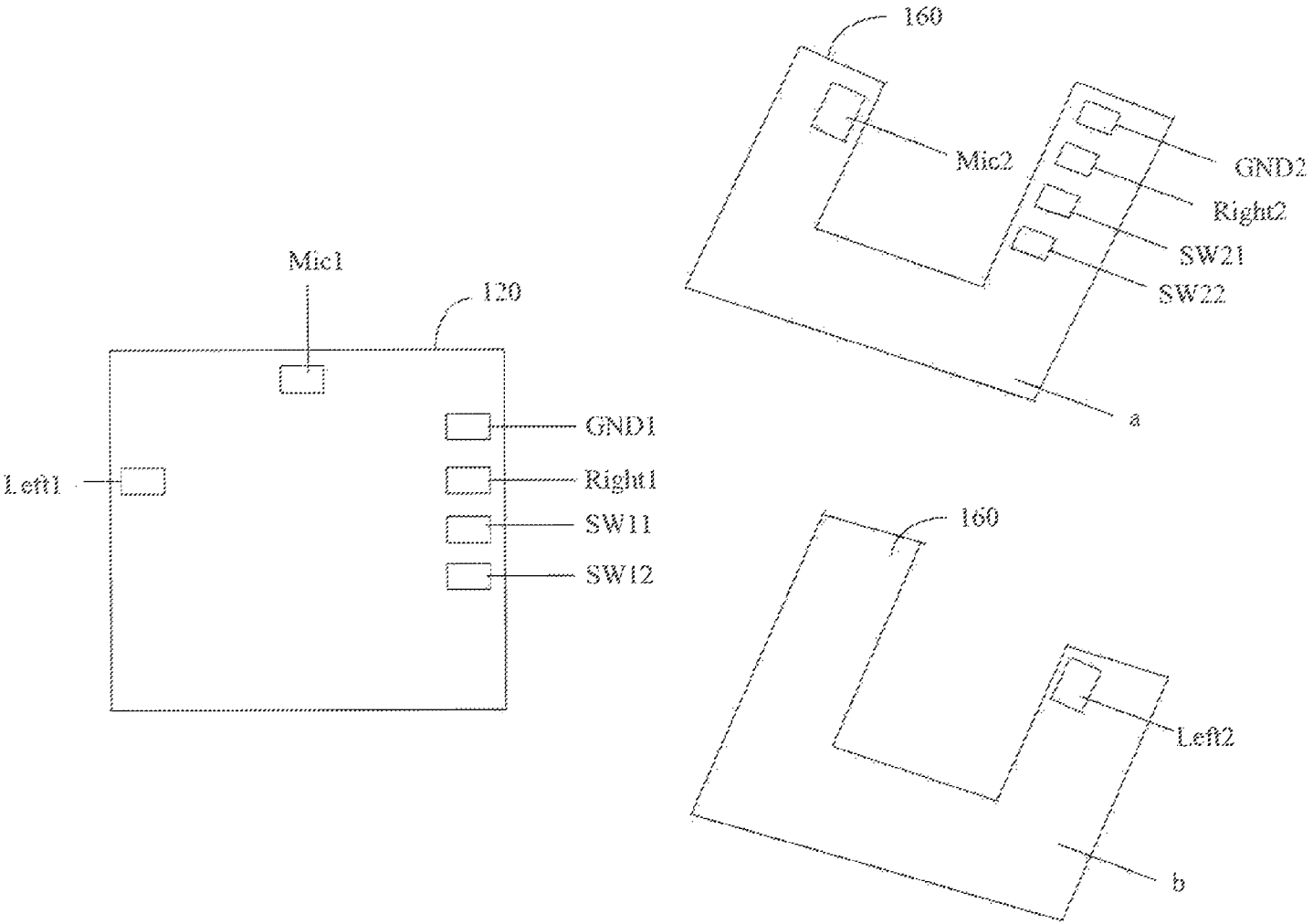
FIG. 2B is a schematic diagram illustrating an arrangement of metal contact terminals on an insulated base and contact points on a circuit board, according to an exemplary embodiment.

FIG. 2B is a schematic diagram illustrating an arrangement of metal contact terminals on the insulated base 120 and contact points on the circuit board 160 (FIG. 1), according to an exemplary embodiment. Referring to FIG. 2B, a metal contact terminal Mic1, a metal contact terminal GND1, a metal contact terminal Right1, a metal contact terminal Left1, a metal contact terminal SW11, and a metal contact terminal SW12 are provided on the insulated base 120. In the illustrated embodiment, the metal contact terminals GND1, Right1, SW11 and SW12 are arranged along the slot direction of the slot 150.

In addition, contact points Mic2, UNIX, Right2, SW21, and SW22 are provided on a first surface of the circuit board 160, and a contact point Left2 is provided on a second surface of the circuit board 160. In the illustrated embodiment, the contact points, GND2, Right2, SW2, and SW22 are evenly arranged on the circuit board 160.

When the circuit board 160 is plugged into the slots 150, the metal contact terminal Mic1 is connected with the contact point Mic2, the metal contact terminal GND1 is connected with the contact point GND2, the metal contact terminal Right1 is connected with the contact point Right2, and the metal contact terminal Left1 is connected with the contact point Left2. Further, before the audio plug is plugged into the socket 140, the metal contact terminal SW11 is disconnected with the contact point SW21, and the metal contact terminal SW12 is disconnected with the contact point SW22, which indicates that the audio plug is not plugged. After the audio plug is plugged into the socket 140, the metal contact terminal SW11 is connected with the contact point SW21, and the metal contact terminal SW12 is connected with the contact point SW22, which indicates that the audio plug is plugged.

The audio jack 100 overcomes the problem in the related art that the conventional audio jack needs the cooperation of the external configuration to be crimped on the circuit board, and achieves the effects that the audio jack 100 can be separately contacted with the circuit board and can hold the circuit board without the cooperation of the external configuration. Moreover, since the body of the audio jack 100 in the present disclosure is located at both sides of the circuit board, it facilitates meeting design requirements for an ultrathin electronic device.

In addition, the circuit board 160 can be firmly held by the upper plate 121 and the lower plate 122, which can avoid the poor effect of audio signal transmission caused by loose contact between the audio jack and the circuit board due to a displacement of the circuit board when the external configuration is deformed or collided. In addition, the circuit board may be drawn from the slot, which facilitates replacing components and performing maintenance.

In exemplary embodiments, there is also provided an electronic device including a circuit board, such as the circuit board 160 (FIG. 1), and an audio jack coupled to the circuit board, such as the audio jack 100 (FIG. 1).

Figure 3:
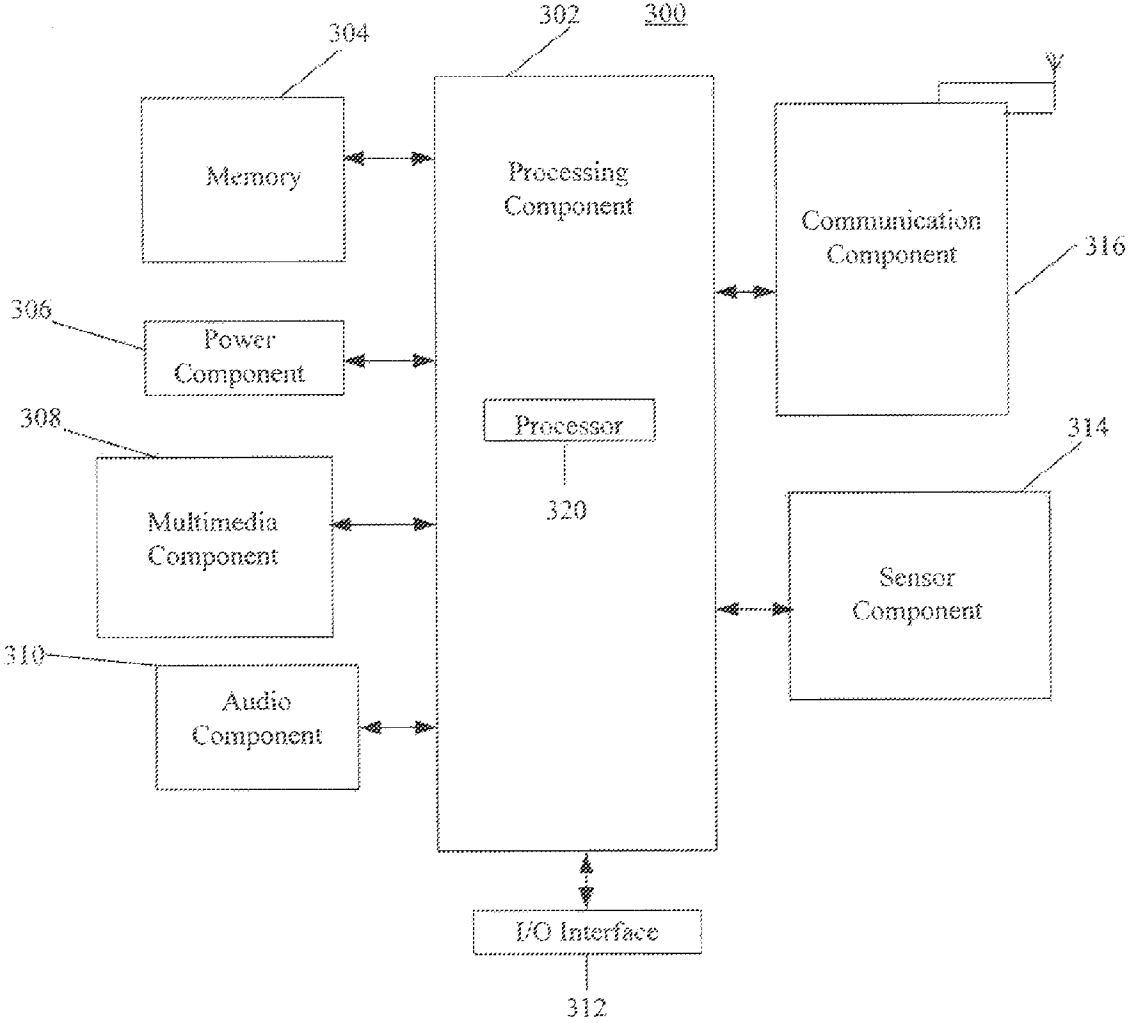
FIG. 3 is a block diagram of an electronic device, according to an exemplary embodiment.

FIG. 3 is a block diagram of an electronic device 300, according to an exemplary embodiment. For example, the electronic device may be a mobile phone, a computer, a digital broadcast terminal, a messaging device, a gaming console, a tablet, a medical device, exercise equipment, a personal digital assistant, and the like.

Referring to FIG. 3, the electronic device 300 may include one or more of the following components: a processing component 302, a memory 304, a power component 306, a multimedia component 308, an audio component 310, an input/output (110) interface 312, a sensor component 314, and a communication component 316.

The processing component 302 typically controls overall operations of the electronic device 300, such as the operations associated with display, telephone calls, data communications, camera operations, and recording operations. The processing component 302 may include one or more processors 320 to execute instructions. Moreover, the processing component 302 may include one or more modules which facilitate the interaction between the processing component 302 and other components. For instance, the processing component 302 may include a multimedia module to facilitate the interaction between the multimedia component 308 and the processing component 302.

The memory 304 is configured to store various types of data to support the operation of the electronic device 300. Examples of such data include instructions for any applications or methods operated on the electronic device 300, contact data, phonebook data, messages, pictures, video, etc. The memory 304 may be implemented using any type of volatile or non-volatile memory devices, or a combination thereof, such as a static random access memory (SRAM), an electrically erasable programmable read-only memory (EEPROM), an erasable programmable read-only memory (EPROM), a programmable read-only memory (PROM), a read-only memory (ROM), a magnetic memory, a flash memory, a magnetic or optical disk.

The power component 306 provides power to various components of the electronic device 300. The power component 306 may include a power management system, one or more power sources, and any other components associated with the generation, management, and distribution of power in the electronic device 300.

The multimedia component 308 includes a screen providing an output interface between the electronic device 300 and the user. In some embodiments, the screen may include a liquid crystal display (LCD) and a touch panel (TP). If the screen includes the touch panel, the screen may be implemented as a touch screen to receive input signals from the user. The touch panel includes one or more touch sensors to sense touches, swipes, and gestures on the touch panel. The touch sensors may not only sense a boundary of a touch or swipe action, but also sense a period of time and a pressure associated with the touch or swipe action. In some embodiments, the multimedia component 308 includes a front camera and/or a rear camera. The front camera and the rear camera may receive an external multimedia datum while the electronic device 300 is in an operation mode, such as a photographing mode or a video mode. Each of the front camera and the rear camera may be a fixed optical lens system or have focus and optical zoom capability.

The audio component 310 is configured to output and/or input audio signals. For example, the audio component 310 includes a microphone ("MIC") configured to receive an external audio signal when the electronic device 300 is in an operation mode, such as a call mode, a recording mode, and a voice recognition mode. The received audio signal may be further stored in the memory 304 or transmitted via the communication component 316. In some embodiments, the audio component 310 further includes a speaker to output audio signals. The audio component 310 also includes an audio jack, such as the audio jack 100 (FIG. 1).

The I/O interface 312 provides an interface between the processing component 302 and peripheral interface modules, such as a keyboard, a click wheel, buttons, and the like. The buttons may include, but are not limited to, a home button, a volume button, a starting button, and a locking button.

The sensor component 314 includes one or more sensors to provide status assessments of various aspects of the electronic device 300. For instance, the sensor component 314 may detect an open/closed status of the electronic device 300, relative positioning of components, e.g., the display and the keypad, of the electronic device 300, a change in position of the electronic device 300 or a component of the electronic device 300, a presence or absence of user contact with the electronic device 300, an orientation or an acceleration/deceleration of the electronic device 300, and a change in temperature of the electronic device 300. The sensor component 314 may include a proximity sensor configured to detect the presence of nearby objects without any physical contact. The sensor component 314 may also include a light sensor, such as a CMOS or CCD image sensor, for use in imaging applications. In some embodiments, the sensor component 314 may also include an accelerometer sensor, a gyroscope sensor, a magnetic sensor, a pressure sensor, or a temperature sensor which can be used to collect the natural environment temperature and/or the human body temperature.

The communication component 316 is configured to facilitate communication, wired or wirelessly, between the electronic device 300 and other devices. The electronic device 300 can access a wireless network based on a communication standard, such as WiFi, 2G, or 3G, or a combination thereof. In one exemplary embodiment, the communication component 316 receives a broadcast signal or broadcast associated information from an external broadcast management system via a broadcast channel. In one exemplary embodiment, the communication component 316 further includes a near field communication (NFC) module to facilitate short-range communications. For example, the NFC module may be implemented based on a radio frequency identification (RFID) technology, an infrared data association (IrDA) technology, an ultra-wideband (UWB) technology, a Bluetooth (BT) technology, and other technologies.

In exemplary embodiments, the electronic device 300 may be implemented with one or more application specific integrated circuits (ASICs), digital signal processors (DSPs), signal processing devices (DSPDs), programmable logic devices (FLDs), field programmable gate arrays (FPGAs), controllers, micro-controllers, microprocessors, or other electronic components.

Other embodiments of the invention will be apparent to those skilled in the art from consideration of the specification and practice of the invention disclosed here. This application is intended to cover any variations, uses, or adaptations of the invention following the general principles thereof and including such departures from the present disclosure as come within known or customary practice in the art. It is intended that the specification and examples be considered as exemplary only, with a true scope and spirit of the invention being indicated by the following claims.

It will be appreciated that the present invention is not limited to the exact construction that has been described above and illustrated in the accompanying drawings, and that various modifications and changes can be made without departing from the scope thereof. It is intended that the scope of the invention only be limited by the appended claims.

What is claimed is:

1. An audio jack, comprising:

an insulated base including an upper plate and a lower plate connected to the upper plate, wherein a connecting portion between the upper plate and the lower plate forms a socket for plugging an audio plug, and a slot, formed between facing surfaces of the upper plate and the lower plate, is configured for installing a circuit board in a plugging manner, the slot including first and second parallel slots and a third slot connecting the first and second parallel slots; and a metal contact terminal configured to electrically connect the audio plug plugged into the socket to a corresponding conductive trace on the circuit board installed in the slot.

2. The audio jack according to claim 1, wherein the first and second parallel slots are formed between the facing surfaces of the upper plate and the lower plate; and the facing surfaces of the upper plate and the lower plate are configured to hold the circuit board after the circuit board is installed.

3. The audio jack according to claim 2, wherein a central axis line of the socket is parallel to the first and second parallel slots.

4. The audio jack according to claim 1, wherein a first end of the metal contact terminal forms a contact point in the socket, and a second end of the metal contact terminal forms a contact point in the slot.

5. The audio jack according to claim 4, wherein the contact point in the slot formed by the second end of the metal contact terminal is an elastic contact point.

6. The audio jack according to claim 1, further comprising:

a plurality of metal contact terminals insulated from each other.

7. The audio jack according to claim 6, wherein contact points formed by the plurality of metal contact terminals, respectively, in the slot are evenly arranged in a slot direction of the slot.

8. An electronic device, comprising:

a circuit board; and an audio jack coupled to the circuit board, wherein the audio jack includes:

an insulated base including an upper plate and a lower plate connected to the upper plate, wherein a connecting portion between the upper plate and the lower plate forms a socket for plugging an audio plug, and a slot, formed between facing surfaces of the upper plate and the lower plate, is configured for installing the circuit board iii a plugging manner, the slot including first and second parallel slots and a third slot connecting the first and second parallel slots; and a metal contact terminal configured to electrically connect the audio plug plugged into the socket to a corresponding conductive trace on the circuit board installed in the slot.

9. The electronic device according to claim 8, wherein the first and second parallel slots are formed between the facing surfaces of the upper plate and the lower plate; and the facing surfaces of the upper plate and the lower plate are configured to hold the circuit board after the circuit board is installed.

10. The electronic device according to claim 9, wherein a central axis line of the socket is parallel to the first and second parallel slots.

11. The electronic device according to claim 8, wherein a first end of the metal contact terminal forms a contact point in the socket, and a second end of the metal contact terminal forms a contact point in the slot.

12. The electronic device according to claim 11, wherein the contact point in the slot formed by the second end of the metal contact terminal is an elastic contact point.

13. The electronic device according to claim 8, wherein the audio jack further includes:

a plurality of metal contact terminals insulated from each other.

14. The electronic device according to claim 13, wherein contact points formed by the plurality of metal contact terminals, respectively, in the slot are evenly arranged in a slot direction of the slot.

* * * * *